United States Patent [19]

Keeler

[11] 4,337,870

[45] Jul. 6, 1982

[54] TAMPER-PROOF CLOSURE CAP AND METHOD OF FABRICATION

[76] Inventor: Frederick D. Keeler, 55 Strobel Rd., Trumbull, Conn. 06611

[21] Appl. No.: 142,964

[22] Filed: Apr. 23, 1980

[51] Int. Cl.[3] ..... B65D 41/34

[52] U.S. Cl. ..... 215/252; 264/156

[58] Field of Search ..... 215/250, 251, 252, 253, 215/256, 258; 264/156, 328; 220/266

[56] References Cited

U.S. PATENT DOCUMENTS

| | | | |
|---|---|---|---|
| 3,504,818 | 4/1970 | Crisci et al. | 215/252 |
| 3,904,061 | 9/1975 | Keeler | 215/252 |
| 4,225,050 | 9/1980 | Reinhart | 215/252 |

*Primary Examiner*—George T. Hall

*Attorney, Agent, or Firm*—Frank J. Thompson

[57] ABSTRACT

A thermoformed, polymer plastic closure body is disclosed having integrally formed cap, ring and frangible bridge members. Ratchet segments and a collar segment are integrally formed with the ring member and the frangible bridge members extend between the cap member and the collar segment at a location intermediate the ratchet segments for limiting a force applied to the bridge member during mounting rotation of the closure member upon a container. The bridge members are slanted for further reducing the applied force during rotation and the cross sectional area of the bridge member is configured for causing a sheared bridge member to be retained with the ring member. An improved method for fabricating the closure body provides for thermoforming a sheet of polymer plastic to provide a body having integrally formed cap and ring members, and, subsequently mechanically lancing arcuate segments to provide arcuate grooves which are spaced apart by integrally formed bridge members.

17 Claims, 12 Drawing Figures

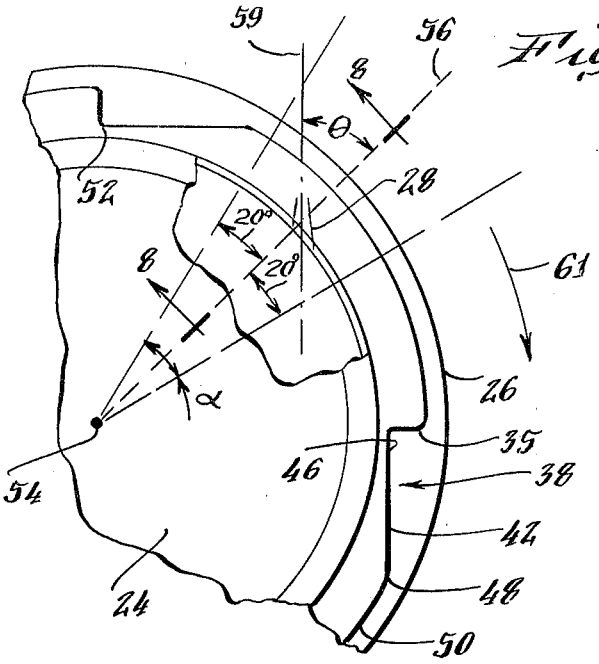
Fig. 7.
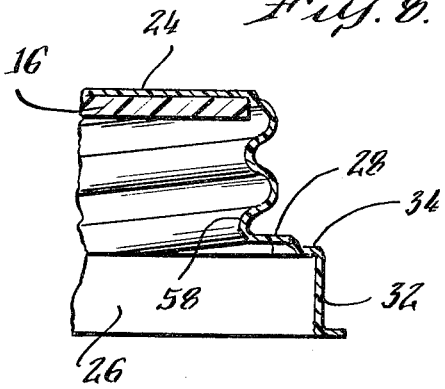
Fig. 8.
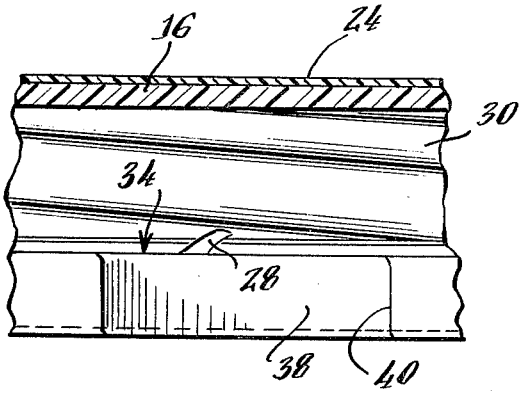
Fig. 9.
Fig. 10.
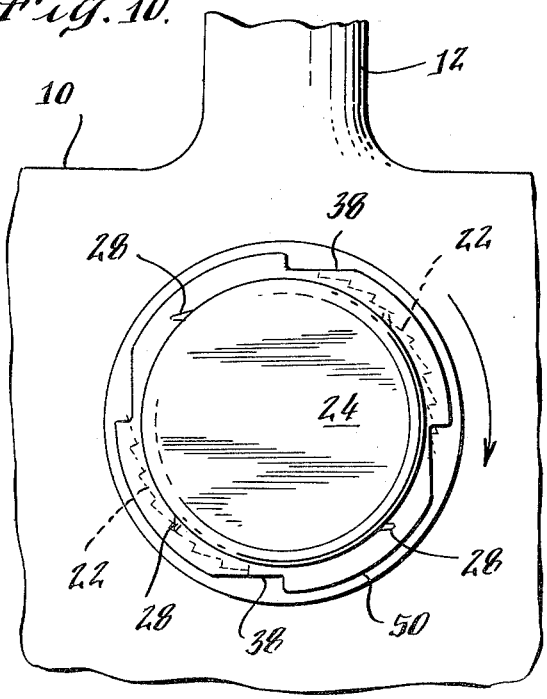
Fig. 11.
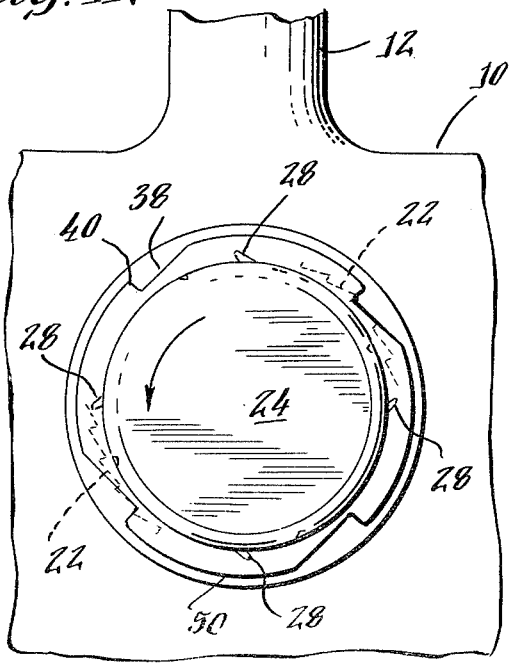

TAMPER-PROOF CLOSURE CAP AND METHOD OF FABRICATION

BACKGROUND OF THE INVENTION

1. Field of the Invention

This invention relates to a closure for a container and more particularly to an improved tamper-proof closure and method of fabricating the closure.

2. Description of the Prior Art

It is desirable to provide a closure body for a container which also visibly indicates unsealing or tampering with the container. This is particularly useful in the area of consumer food products for indicating to the purchaser that the edible contents of the container have not been contaminated or adulterated subsequent to bottling.

A tamper-proof closure body is known which is fabricated of a polymer plastic material and which includes integrally formed cap, ring and frangible bridge members. The cap member is internally threaded for engaging an external thread on a neck of the container; the ring member includes ratchet segments which register with corresponding pawl segments formed on the container; and, the frangible bridge members intercouple the cap and ring members adjacent the ratchet segments and maintain these members in spaced relationship. When this form of tamperproof cap is initially rotated into engagement with the neck of the container, the plurality of ratchets on the resilient ring rotate over and engage the pawls formed on the container neck. A subsequently applied reverse, removal force will encounter a restriction to ring member motion which is presented by the container pawl segments. The continued application of this force in a reverse direction will rupture the frangible bridge members and break away the closure member from the ring member thus leaving the separated ring member in an engaged position on the pawl portion of the bottle and visibly indicating that the closure has been removed.

Initial mounting of the closure body is accomplished by rotating the cap member until the closure body fully engages the container neck. The frangible bridge members should provide sufficient strength for maintaining mechanical integrity during this procedure while on the other hand enabling breaking of the cap when desired.

In order to facilitate initial mounting of the closure body on the container neck without rupturing the frangible members during this procedure, the closure body has generally been fabricated of a polymer plastic such as polyethylene which exhibits a resilient characteristic and permits the closure ring member to experience a limited deflection as the ring ratchet segments stretch and slide over the container pawl segments. However, a relatively large number of frangible members have also been provided to assure the desired mechanical integrity of the closure body during the initial mounting procedure. At times up to nine frangible members have been provided. As the number and holding capacity of these members is increased, the breakaway force is disadvantageously increased and often presents an imposing task to the housewife and to young children.

Closure bodies of the type described utilizing a resilient polymer plastic are formed of materials which are generally fabricated by an injection molding technique. This process is a relatively more expensive fabrication process than a thermoforming process for fabricating polymer plastic articles. However, the latter process is generally limited to polymer plastics which do not exhibit resilient characteristics as have been utilized with closure bodies as described hereinbefore.

Other desirable characteristics in a tamper-proof closure body include severing the frangible bridge members with the ring member which is then discarded thus avoiding the potential for abrasion to the hand from the sheared bridge members should they be retained on the cap member. It is also desirable that the ring configuration avoid the accumulation of foreign particles which contributes to potential contamination in edible goods.

SUMMARY OF THE INVENTION

Accordingly, it is an object of this invention to provide an improved tamper-proof closure body.

Another object of the invention is to provide a relatively economical tamper-proof closure body.

Another object of the invention is to provide a thermoformed, polymer plastic tamper-proof closure body.

Another object of the invention is to provide a thermoformed, polymer plastic tamper-proof closure body having integrally formed cap, ring and frangible bridge members.

Another object of the invention is to provide a thermoformed, polymer plastic tamper-proof closure body having a plurality of frangible bridge members which are arranged to establish mechanical integrity of the closure body upon rotating the cap member in a first direction while mounting the body to a container and which can be readily ruptured upon a reverse rotation of the cap member.

Another object is to provide an improved method for fabricating a tamper-proof closure member for a container.

In accordance with the general features of this invention, there is provided a relatively economical tamper-proof closure body having integrally formed cap, ring and a plurality of frangible bridge members and which is thermoformed of a polymer plastic material. The ring member includes integrally formed ratchet segments which are spaced apart circumferentially and which engage pawl segments on a neck of a container. The integrally formed frangible bridge members extend between the cap and ring member and maintain these members in spaced relationship. A frangible bridge member is positioned between adjacent ratchet segments and is located at a circumferential position for restricting a force applied to the bridge member as the closure body is initially rotated into engagement with the neck of the container In accordance with more particular features of the invention, a frangible bridge member is located within an arcuate distance of about 40° which is centered between adjacent ring ratchet segments. Preferably, a frangible bridge member is located equidistant between step locations of adjacent ratchet segments. The ring member includes collar and shoulder segments and the cap member includes a wall segment. The shoulder segment extends inward radially toward the cap member and the frangible bridge member extends between the lower wall segment and the shoulder segment.

In accordance with other features of the invention, the frangible bridge member extends between the cap and ring member in a direction forming an angle $\theta$ with a radial line through a center axis of the closure member. Through this orientation, a rotational force which is applied to the frangible bridge member during the initial mounting procedure exhibits a reduced shearing force component in comparison with the force which would be applied to a radially extending bridge member. The frangible bridge member also has a tapering cross sectional configuration for enhancing shearing of the bridge member during breakaway.

In accordance with features of the method of this invention, a tamper-proof closure body is fabricated by the steps of thermoforming a sheet of polymer plastic material to provide a closure body having integrally formed cap and ring members. The thermoformed cap member includes a threaded segment and the thermoformed ring segment includes a plurality of ratchet segments having steps. Subsequent to thermoforming, a plurality of circular, arcuate grooves are mechanically formed between the cap and ring members and are separated by a plurality of mechanically formed frangible bridge members spaced at locations between adjacent ratchet segments.

BRIEF DESCRIPTION OF THE DRAWINGS

These and other objects and features of the invention will become apparent with reference to the following specification and to the drawings wherein:

FIG. 7 is an enlarged fragmentary view, partly broken away, of the closure body of FIG. 3;

FIG. 8 is a fragmentary view, partly in section, taken along line 8—8 of FIG. 7;

FIG. 9 is an enlarged, fragmentary, side elevation view, partly in section of the closure body of FIG. 8 illustrating a frangible bridge segment;

FIG. 10 is a plan view of the closure body of FIG. 3 mounted on the container of FIG. 1;

FIG. 11 is a plan view illustrating the rotation and rupture of the frangible members of the closure assembly; and, FIG. 12 is a diagram illustrating the method steps of this invention.

DETAILED DESCRIPTION

Figure 1:
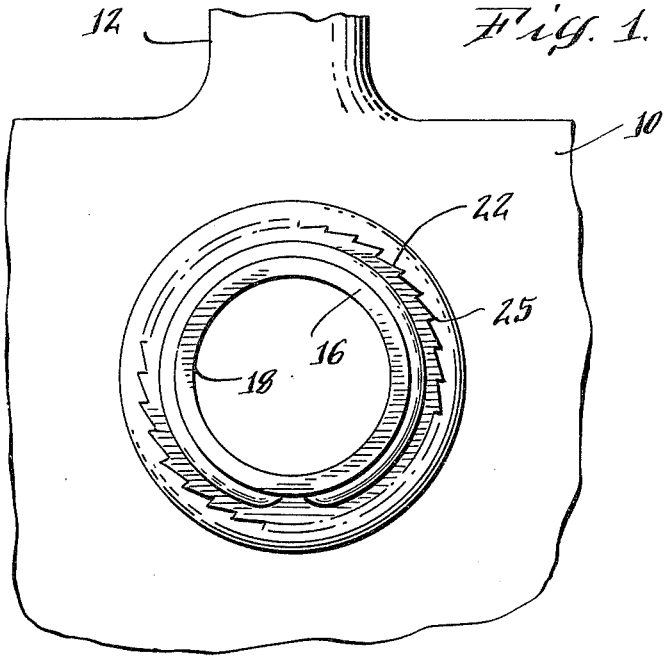
FIG. 1 is a fragmentary, plan view of a container with which the closure body of the present invention is utilized.
Figure 5:
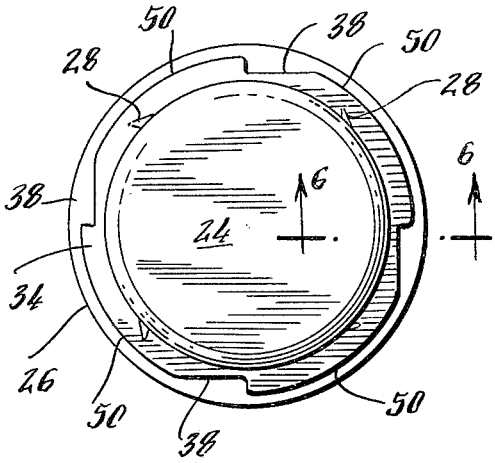
FIG. 5 is a plan view of the closure body of FIG. 3.
Figure 2:
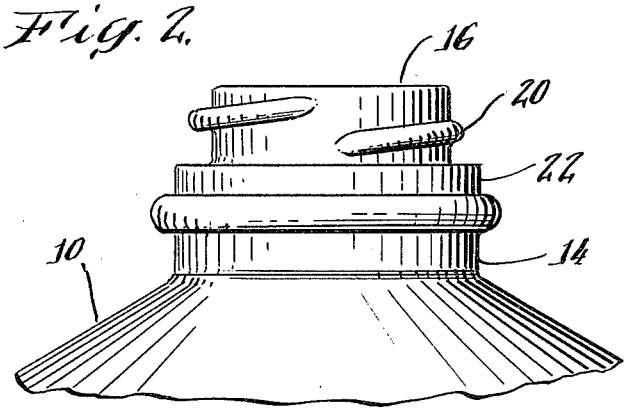
FIG. 2 is a fragmentary, side elevation view of the container of FIG. 1.
Figure 3:
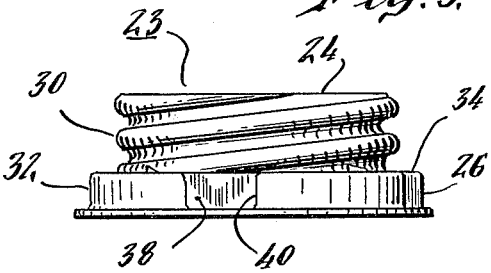
FIG. 3 is a side elevation view of a closure body constructed in accordance with features of this invention.
Figure 4:
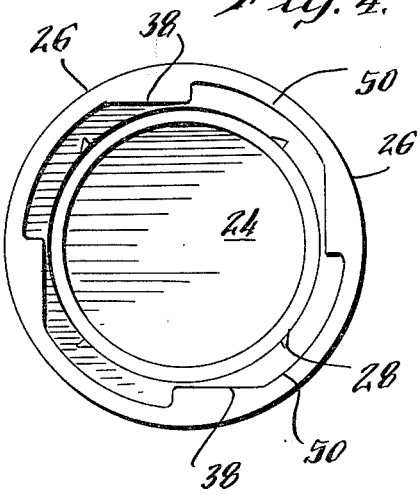
FIG. 4 is a bottom view of the closure body of FIG. 3.

Referring now to FIGS. 1 and 2 of the drawings, there is illustrated a container shown to be a plastic milk bottle 10 having an integrally formed handle segment 12 and an integrally formed neck segment 14. While a milk bottle is shown for purposes of this description, the invention is equally applicable to containers for other products. The neck segment at an uppermost location 16 has a circular aperture 18 and includes on the outer periphery of the upper neck segment an integrally formed, external thread segment 20 for engaging a closure body, described hereinafter. A plurality of teeth 22 which, for purposes of this Application, are hereinafter referred to as pawl teeth, are arranged in two arcuate configurations about a lower outer surface of the neck 14. The individual pawl teeth of this array, as best seen in FIG. 1, extend in a clockwise direction. Each pawl tooth includes a step segment 25 for engaging a segment of a closure body described hereinafter.

A tamper-proof closure body for use with the container 10 comprises a thermoformed, polymer plastic body 23 (FIGS. 3-8) having an integrally formed cap member 24, an integrally formed breakaway ring member 26 and a plurality of integrally formed frangible bridge members 28 which maintain the cap and ring members in a spaced relationship. Closure body 23 is of thin walled construction and has a thickness in the range of about 0.020 in. to about 0.040 in. A preferred thickness is 0.030 in. While the body 23 can be fabricated of various polymer plastics suitable for thermoforming, a preferred material is medium impact, polystyrene. Cap member 24 is sized in diameter to conform with the diameter of the upper neck segment and includes an internally formed thread 30 for engaging the thread 20 of the container neck 14.

The ring member 26 is generally circular shaped and includes a collar segment 32 (FIG. 8) and a shoulder segment 34. The shoulder segment 34 extends radially inwardly toward the cap member 24 and is separated therefrom by a plurality of relatively narrow arcuate grooves 35 (FIG. 7) which are mechanically formed in the body 23. This forming operation results in a plurality of narrow arcuate extending grooves having a width about equal to the width of the cutting edge of a shearing knife. They are spaced apart by the frangible bridge members 28. A circular foot segment 36 (FIG. 8) extends radially outwardly from the collar segment 32 of the ring member 26. The thin walled ring member 26 is formed into a configuration having a plurality of integrally formed ratchet segments spaced about the circumference of the ring member and which are configured for engaging the pawl teeth 22 of the bottle 10 when the closure member 23 is initially mounted on the container 10. These ratchet segments which are referred to generally by reference numeral 38 (FIG. 7) include a step segment 40 and a ramp or inclined plane segment 42 having a foot segment 46 immediately adjacent the preceeding step 40 and a head segment 48 which is located immediately preceeding a circular segment 50 of the ring member. The ramp segments 38 are spaced apart by circular, arcuate segments 50 of the ring member.

The plurality of frangible bridge members 28 are shown to be integrally formed with the cap member 24 and the ring member 26. These members maintain the cap member and the ring member in spaced relationship. As the closure body 23 is initially rotatably mounted to the container 10, a force is applied to the ring member 26 by the pawl teeth 22 which tends to spread or stretch the ring member 26 partially outward from the bottle 10. This force which is coupled from the ring member to the frangible bridge member 28 increases to a maximum value when a lower segment 52 of the ratchet step segment 40 adjacent to the ramp foot segment 46 engages a raised head segment 25 of the pawl teeth 22. At this point, spreading of cap and ring member is greatest and the force of the frangible bridge members is greatest. Positioning of the frangible bridge members at a location intermediate the ramp segments 40 reduces the magnitude of force which is applied to a bridge member during the mounting procedure. A radial line through the center 54 of the closure body 23 and equidistant from steps 40 of adjacent ramps is represented by the reference numeral 56. The frangible bridging member 28 is located within a range of arcuate locations extending up to about 20° measured in opposite directions from the line 56. This 40° range is centered about the line 56. Preferably, the frangible bridge member 28 is centrally located at a position indicated by line 56 midway between the steps 40 of adjacent ramp segments 38. Thus, by locating frangible bridge member between the steps 40 of the adjacent ratchet segments 38, the shearing force applied to the frangible member 28 when the closure body 23 is initially mounted to the container 10 is substantially reduced. The numbers of such members 28 utilized for maintaining the spaced relationship between the cap member and the ring member is accordingly reduced as is the breakaway force which must be applied in an opposite direction.

The frangible bridge members 28 are elongated and are integrally formed with the shoulder segment 34 of the ring member and a lower side wall segment 58 of the cap member. An elongated, frangible bridge member 28 extends in a direction along a line 59 (FIG. 7) which forms an angle $\theta$ with a radial line of the cap member 24 such as the radial line 56 of FIG. 7. The orientation of the frangible bridge member 28 at an angle $\theta$ reduces the shearing force applied to the member 28 in comparison with a shearing force which would be applied to a radially extending bridge member, when the closure body 23 is initially rotated and mounted to the bottle 10. The bridge member 28 slants in the direction of rotation of the closure body as it is rotated and mounted to the bottle 10, which, as illustrated by the arrow 61 in FIG. 7 is in a clockwise direction. A force transmitted from the bridge member 28 to the ring member 26 during mounting rotation has a principal force component extending along the length of the bridge member and a relatively smaller force component extending normal to the length of the bridge member. This results in the application of a substantially reduced shearing force component to the bridge member. A rotary mounting force which is applied to the cap member 24 operates to effectively drag the ring member 26 over the pawl teeth 22 during mounting rotation. The angle $\theta$ can be adjusted as desired to enhance this force distribution characteristic. As the magnitude of the angle $\theta$ increases, the length of the bridge member 28 should be lengthened. Generally speaking, the shorter the length of the frangible bridge member 28 the less the angle $\theta$. A preferred value of $\theta$ is 45°.

The cross sectional configuration of the frangible bridge member 28 tapers in cross sectional area from a smaller cross sectional dimension adjacent the lower wall segment 58 of the cap 24 to a wider cross section at the shoulder segment 34 of the ring member 26. Breakaway rotation of the cap member 24 causes shearing of the members 28 at the lower wall segment 58 of the cap. The sheared bridge members 28 are thus retained with the ring member 26. The ring member is discarded after breakaway of the cap member. This feature avoids potential lacerations to a user's hand which might occur if the bridge members 28 were sheared at the ring and were retained along the edge of the cap member. The taper of the frangible bridge members can also be varied to vary the desired strength requirements in accordance with variations of the angle $\theta$ and the length of the bridge member as indicated hereinbefore.

In a preferred arrangement, the ring member ratchet segment 38 extends for an arcuate distance of about 30° and the intermediate circular arcuate segment 50 which spaces apart adjacent ratchet segments extends for an arcuate distance of about 60°. The step segments 40 of the ramp segments 38 are thus spaced at about 90° intervals on the ring member and a frangible bridge segment 28 is preferably located at an arcuate position of 45° or midway between each of the steps 40. In this preferred arrangement, there is thus provided four ramp segments 38 and four frangible bridge members 28. While dimensions of the closure body can be varied for particular applications, an exemplary closure body 23 for use with a milk container and having the preferred ratchet arrangement as described has a cap member diameter of about 1.5 in. and a ring member diameter of about 1.72 in. Bridge member 28 has an average width of about 0.030 in.

Mounting of the closure body 23 to the container 10 is accomplished by screwing the body 23 onto the threaded neck segment 20 of the container neck 14 until the threaded segment of closure body and container are engaged and seated and a step 40 of the ratchet segment 38 is seated against a corresponding step segment of a pawl tooth 22 of the container. Under these conditions, the tamper-proof closure body is secured on the container. A counterclockwise rotational force applied to the cap member, as illustrated in FIG. 11, causes shearing of the frangible bridge members 28 thus enabling removal of the cap member 24. The sheared condition of the frangible members 28 provides a visible indication that the cap has been removed subsequent to filling of the container. Under ordinary circumstances, the consumer or purchaser will rotate the cap in a counterclockwise direction, as illustrated in FIG. 11, to cause rupturing of the frangible bridge segment 28. The cap member 24 is removed and the ring member 26 can then be removed and discarded while the cap member 24 is replaced.

It may be desirable at times to use a liner or gasket sheet with certain beverage containers. To this end a circular sealing body 62 (FIG. 6) comprising a foam plastic material such as styrafoam is provided and seated in the cap member 24.

Figure 6:
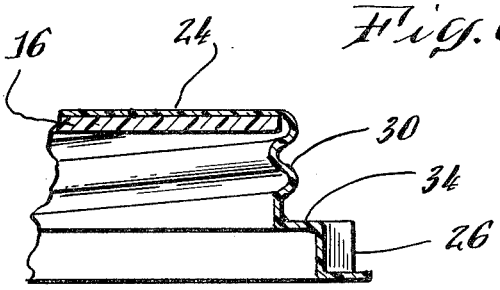
FIG. 6 is a fragmentary view, partly in section, taken along line 6—6 of FIG. 5.
Figure 12:
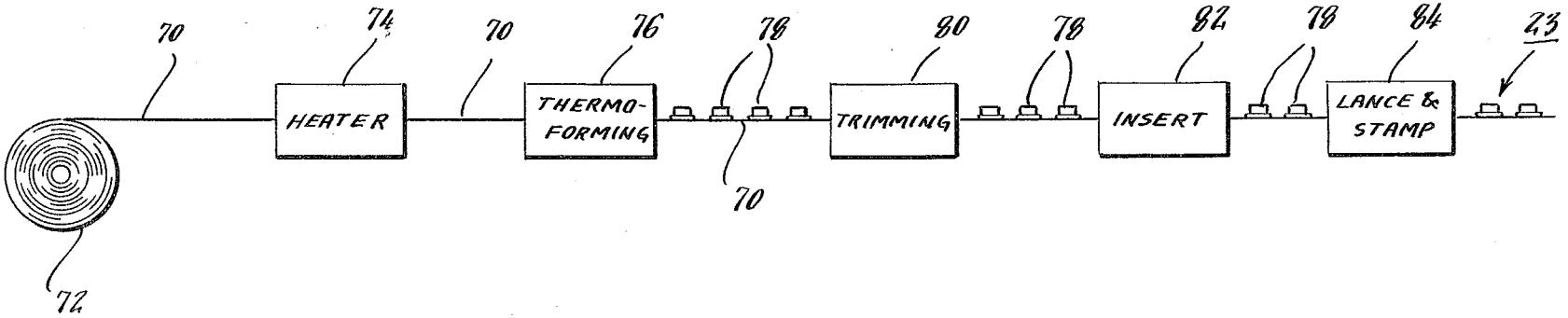

The closure body 23 described hereinbefore is fabricated by a process illustrated schematically in FIG. 12. A sheet 70 of 0.030 in. medium impact polystyrene is supplied from a roll 72 to a heater station 74 at which location the sheet 70 is warmed to a plastic state. The warmed sheet 78 is then advanced to a thermoforming mold at a thermoforming station 76 at which location the mold is clamped and cycled. The mold is configured for thermoforming the sheet 70 to provide a plurality of closure bodies 78 on the sheet 70 each having an integrally formed cap member 24 and an integrally formed ring member 26, as described hereinbefore. Sheet 70, with the plurality of integrally formed closure bodies 78, is advanced to a trimming station 80 at which location the sheet 70 is trimmed to provide a plurality of separated closure bodies 78. These separated closure bodies are advanced to an insert station 82 at which location an insert 62, described hereinbefore with respect to FIG. 6, is positioned in each closure body. The closure body with insert is then advanced to a shearing station 84 at which station the closure body is mechanically lanced and stamped to provide arcuate grooves 35, as illustrated in FIG. 7, which are spaced apart by frangible bridge members 28. The grooves 35 thus formed are relatively narrow and have a width which is about equal to the cutting edge of the lancing knife edge.

The tolerances during the lancing and stamping operation are relatively close and should be maintained to the order of 0.010 in. After the bodies 78 have been thermoformed at station 76 they are not fully cured. The provision of the intermediate lancing and stamping station and the placement of the insert 62 at the insert station 82 provides a time interval during which the bodies 78 cure and the shrinkage is completed. The bodies 78 are then conditioned for the lancing and stamping operation.

The closure body 23 and the method for fabricating the same, as described, is particularly advantageous in that a tamper-proof closure body is provided which is formed of a polymer plastic by a thermoformed process thus enabling a substantial reduction both in the cost of the material and the process for forming the body. The relatively rigid or stiff plastic material from which the closure body is formed is compensated for during the mounting process by the use of frangible bridge members which are located at positions of relatively low stress along the circumference of the body. A relatively small number of frangible bridge members can be utilized thus reducing the shearing force which must be applied to the cap for removal of the cap from the container. The particular arrangement of the frangible bridge member facilitates the shearing.

While there has been described a particular embodiment of the invention, it will be appreciated by those skilled in the art that modifications may be made thereto without departing from the spirit of the invention the scope of the appended claims.

What is claimed is:

1. An improved closure member comprising:

a. a closure body thermoformed of a polystyrene material;

b. said closure body including a generally annular shaped cap member, a generally annular shaped shoulder member integrally formed with said cap member and a generally annular shaped skirt member, said shoulder member having a plurality of arcuate cuts and a plurality of frangible bridge members mechanically formed therein, said bridge members extending between said cap and skirt members for maintaining said cap and bridge members in spaced relationship; and, c. said frangible bridge members circumferentially positioned about said shoulder member and extending outwardly from said cap member to said skirt member.

2. An improved closure body for use with a container having a plurality of pawl teeth formed about a neck thereof comprising:

a. a closure body of thermoformed polymer plastic;

b. said closure body having generally annular shaped, integrally formed cap and ring members and a plurality of frangible bridge members extending between said cap and ring members for maintaining said cap and ring members in spaced relationship;

c. said ring member including a plurality of integrally formed ratchet segments positioned in a circular array and spaced apart by circular arcuate segments; and, d. said frangible bridge members positioned circumferentially between said ratchet segments.

3. The closure body of claim 2 wherein said frangible bridge members extend between said cap member and said arcuate segment of said ring member.

4. The closure body of claim 2 wherein said frangible bridge members are located equidistant between said ratchet segments.

5. The closure body of claim 2 wherein said ratchet segments include integral step segments and said frangible bridge members are located equidistant between step segments of adjacent ramp segments.

6. The closure body of claim 2 wherein a frangible bridge member is located within an arcuate angle $\alpha$ which is centered about a radial line through a longitudinal axis of the cap member which radial line is located equidistant between adjacent ramp segments.

7. The closure body wherein said angle $\alpha$ has a magnitude of about 40°.

8. The closure body of claim 2 wherein said ratchet segments are spaced apart by an angular distance of 90°.

9. The closure body of claim 2 wherein a ramp segment extends for an arcuate distance of about 30° and a circular arcuate segment extends for an arcuate distance of about 60°.

10. The closure body of claim 2 wherein said bridge members extend in a direction along a line which forms an angle $\theta$ with a radial line through a center axis of said cap member.

11. The closure body of claim 10 wherein said angle $\theta$ is about 45°.

12. The closure body of claim 2 wherein said frangible bridge member has a cross sectional configuration which varies along the length of the bridge member.

13. The closure body of claim 10 wherein said cross sectional area of said bridge member is greater at said ring member cap segment relative to said dimension at said cap member wall segment.

14. A container and enclosure therefor comprising:

a. a container having a neck member including a threaded surface thereof and a plurality of pawl teeth arrayed about said neck segment;

b. a tamper-proof closure member of thermoformed polymer plastic for use with said container;

c. said closure member having integrally formed cap and ring members which are maintained in spaced relationship by a plurality of integrally formed frangible bridge members;

d. said cap member having an integrally formed thread for engaging said container thread;

e. said ring member including a plurality of ramp segments for engaging said pawl teeth and inhibiting rotation of said ring member; and, f. said bridge members spaced between said ramp segments for inhibiting shearing of said bridge members upon mounting rotation of said closure member upon said container.

15. A method of forming a closure member for a container comprising the steps of:

(a) thermoforming a polystyrene material to provide a closure body having integral cap, shoulder and skirt members; and subsequently, (b) lancing and stamping said closure body to provide a plurality of annular arcuate grooves in said shoulder which are spaced apart by frangible bridging members which extend between said cap and skirt members.

16. An improved closure for use with a container having a threaded neck and a closure restraining means extending about the neck and integrally formed with the container, comprising:

(a) a closure body thermoformed of a thin-walled, polymer, plastic;

(b) said closure body having an annular-shaped, threaded cap member for engaging said container neck, an annular-shaped shoulder member integrally formed with and extending from said cap member, and an annular-shaped, skirt member extending from said shoulder member;

(c) means integrally formed with said closure body for engaging said container restraining means to inhibit rotation of said closure when positioned on said container; and, (d) a plurality of cuts and frangible bridges mechanically formed in said shoulder member which extend through the thickness of the shoulder member thereby interrupting integral mechanical coupling between said cap and skirt members along the length of said cuts, said cuts separated by said frangible bridges which intercouple said cap and skirt members, (e) whereby upon the application of a manual rotating force to said cap member, said restraining means restrains the motion of said skirt on said container and the rotating force is applied through the cap member to said frangible bridges causing said bridges to break and interrupt the mechanical coupling provided by said bridges between the cap member and the skirt member thereby enabling the removal of said cap member and providing a tamper-proof indication.

17. The improved closure of claim 16, wherein said container restraining means comprises ratchet segments concentrically formed with said threaded neck segment and said means integrally formed in said body for engaging the container restraining means comprises ratchet segments integrally formed in said skirt segment and configured for engaging said container ratchet segments.

* * * * *